US008006867B2

(12) United States Patent
Calvo et al.

(10) Patent No.: US 8,006,867 B2
(45) Date of Patent: Aug. 30, 2011

(54) CAULKING GUN

(76) Inventors: Rafael Adolfo Calvo, Altadena, CA (US); Janet Ellis Calvo, Altandena, CA (US)

( * ) Notice: Subject to any disclaimer, the term of this patent is extended or adjusted under 35 U.S.C. 154(b) by 1223 days.

(21) Appl. No.: 11/698,735

(22) Filed: Jan. 26, 2007

(65) Prior Publication Data

US 2007/0181607 A1 Aug. 9, 2007

Related U.S. Application Data

(60) Provisional application No. 60/763,469, filed on Jan. 27, 2006.

(51) Int. Cl.
*B05B 11/02* (2006.01)

(52) U.S. Cl. ..... 222/82; 222/81; 222/83; 222/391; 222/466; 222/467

(58) Field of Classification Search ..... 22/81, 82, 22/83, 174, 175, 326, 327, 391, 465.1, 467; 222/81, 82, 83, 174, 175, 326, 327, 391, 222/465.1, 466, 467
See application file for complete search history.

(56) References Cited

U.S. PATENT DOCUMENTS 2,877,935 A * 3/1959 Sherbondy ..... 222/391
3,189,226 A * 6/1965 Sherbondy ..... 222/82
4,081,112 A 3/1978 Chang
4,135,644 A * 1/1979 Pacetti ..... 222/81
4,390,115 A 6/1983 Bigham
4,493,437 A 1/1985 Breeden
4,957,223 A 9/1990 Beilush
5,052,314 A * 10/1991 Leini ..... 111/106
5,361,946 A * 11/1994 Ginther et al. ..... 222/175
6,045,005 A 4/2000 Stratton
6,056,156 A 5/2000 Peng
6,464,109 B1 10/2002 Harris
6,640,998 B1 11/2003 Kern et al.
6,672,489 B1 1/2004 Huang
6,691,899 B2 2/2004 Sung
6,908,016 B2 * 6/2005 Chen ..... 222/391
7,364,054 B2 * 4/2008 Klein ..... 222/391

* cited by examiner

*Primary Examiner* — Kenneth Bomberg
(74) *Attorney, Agent, or Firm* — Karish & Bjorgum, PC

(57) ABSTRACT

A caulking gun includes an easily repositionable handle for better ergonomic balance. The handle, able to slide along the length of the gun below the cartridge holder, is engaged and disengaged using the trigger. The handle disengages from the cartridge holder when the trigger is cocked upwards, and then relocks on the cartridge holder when the trigger is squeezed. A nozzle cutter is positioned away from the action of the trigger and handle and a retractable, adjustable arm clip provides a positive secure secondary connection with the user. A trigger bar connects the trigger to an actuator plate, is aligned with a restraining plate and set to engage and disengage with the plunger advancing mechanism such that the plunger shaft slides rearward slightly relieving a cartridge's internal pressure each time the trigger is released.

7 Claims, 8 Drawing Sheets

CAULKING GUN

CROSS-REFERENCES TO RELATED APPLICATIONS

We request filing priority date of Jan. 27, 2006 based on Provisional Application No. 60/763,469 entitled "Dispensing Gun" filed Jan. 27, 2006.

We request amending the title of the invention with this utility application to "CAULKING GUN" to align better with the titles used by similar inventions in this class. Further, we request all drawings submitted with this utility application replace all the drawings submitted with the provisional application.

STATEMENT REGARDING FEDERALLY SPONSORED RESEARCH OF DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

FIELD OF THE INVENTION

The invention described below relates to hand tools and, more particularly, to manually actuated caulking guns.

BACKGROUND OF THE INVENTION

Caulking guns have been developed to provide a convenient way to dispense caulking or silicone compounds from cartridges. The cartridges themselves are generally made with a built-in plastic nozzle and provide a sliding plug on the opposite end of the nozzle. Caulking guns generally include a cartridge holder, a plunger with a shaft for pushing the compound in the cartridge, a handle and a trigger mechanism for advancing the plunger. Once the tip of a nozzle is cut, the seal of a cartridge broken using a poker and the cartridge has been placed in the gun, a user squeezes the trigger, advancing the plunger. The plunger in turn pushes the plug and the cartridge extrudes compound. The previous art generally includes a handle and a plunger advancing mechanism towards the back end of the gun. These guns commonly use two coil springs to achieve the tensions necessary on the plunger's parts. Some more sophisticated guns have "no drip" features that release the pressure on the plungers so that compound does not leak from the nozzles when not in use. Current automatic pressure release mechanisms use additional springs and parts to relieve pressure on the cartridge. These mechanisms relieve a plunger's pressure each time a trigger is released. Other guns require a user to depress a tab to release pressure on the cartridges. Some caulking guns include built-in nozzle (snout) cutters. U.S. Pat. No. 6,045,005 describes a circular opening in the side of a handle with a blade on a trigger for cutting the tip of a nozzle. Although a need for simple construction has been noted in the prior art, multiple coil springs have remained common to most caulking guns, some using as many as three springs, cables; ratchets and tabs which a user must activate to operate.

The construction and operation of common caulking guns necessitate a user to hold the gun with both hands for accurate delivery of compound. Usually one hand cradles a cartridge holder and cartridge; the hand's position supports the majority of the gun's weight. The other hand grips a handle and squeezes a trigger. Although this method of operation is adequate for many uses, some applications do not readily allow a user to hold a gun with both hands. In such cases, a user must support the weight of the entire gun with one hand putting added stress on the user's wrist and making precise delivery of compound more difficult. Some situations call for a user to use one hand for bracing his/her own body and only use a gun with the other hand, for example while standing on a ladder. Other situations call for a user to hold an object with one hand and apply compound with a gun in the other hand. In these cases, the user must draw back the hand holding the gun to align a nozzle's tip with the object being held. Operating a common caulking gun in a drawn back position is awkward, potentially imprecise and may quickly fatigue a user's wrist.

Although the usual design of caulking guns includes a handle and trigger at the rear, two patents show variations to this arrangement. U.S. Pat. No. 6,640,998 describes a device wherein a cartridge holder slides back against a non-moving plunger. Although this action claims to improve the balance of their invention during use, the entire weight of a full cartridge still hangs in front of a user's hand when a new cartridge is placed in the device. Furthermore, this design has the drawback that as a trigger is squeezed, a nozzle's tip pulls away from the point of contact. This motion requires that a user constantly adjust the gun forward during use. U.S. Pat. No. 4,957,223 describes a handle that is placed towards the front of a caulking gun and uses a complex combination of springs and cables to cause it to function. This design may allow for a better balance at the beginning of use if only one hand holds such a gun, but the device does not allow for the option to operate it by the method of cradling the gun with one hand and gripping the handle with the other hand.

BRIEF SUMMARY OF THE INVENTION

It is, accordingly, the object of the present invention to provide a caulking gun whose balance point is adjustable.

Another object of the present invention is to provide the ability to adjust the balance point even while a cartridge remains in a cartridge holder.

Another object of the present invention is to be usable and balanced with either a two-handed grip or single-handed grip.

Another object of the present invention is to provide a sliding handle for adjusting and setting the balance point of a gun.

Another object of the present invention is to provide a simple mechanism for the disengagement and reengagement of a handle from an upper body of the gun using a trigger.

Still another object of the present invention is to reduce the number of springs in the advancing and restraining mechanisms by eliminating the need for multiple springs, and instead use one spring.

Another object of the present invention is to provide a simple automatic means to relieve pressure on a cartridge to prevent oozing after a trigger is squeezed and released without the need for additional springs.

Yet another object of the present invention is to move the location of a nozzle cutter away from the inside of a handle where plastic nozzle tips and caulking compound may lodge; and to move it to the front of a gun where it is more visible, in alignment with a handle and where cut nozzle tips will not be trapped.

Another object of the present invention is to provide an arm support clip that may be employed or left in a retracted position.

Still another object of the present invention is to provide a design that is easy to manufacture and assemble.

One embodiment of a design of this invention has a cartridge holder portion which includes a front disk with an opening for a cartridge nozzle, an upper cartridge rail and a lower cartridge rail, both extend rearward and parallel to each other from the front disk, a hollow stock portion connected to the upper cartridge rail wherein is found a dual function spring, an actuating plate, a restraining plate and a plunger shaft that passes through the stock and each plate.

A handle and trigger are positioned below a cartridge holder and stock, and can slide along a lower cartridge rail. A plunger advancing means connects a trigger and an actuator plate such that it causes the actuator plate to move forward when the trigger is squeezed, yet allows adjustment of the handle's position should a user prefer a different balance point for the gun.

Two separate functions are required to allow a handle to slide: First, a handle repositioning means must be able to disengage a handle from a gun's lower cartridge rail, allow the handle to move to a new position, and then reengage the handle. Second, a plunger advancing means must permit a trigger to disengage from a plunger advancing means, allow a handle to be moved to a new position, and then reengage the trigger to the plunger advancing means.

Here described are four embodiments of mechanisms that connect a handle to the rest of a gun and a trigger to a plunger advancing plate.

In a first embodiment, these two actions must be performed separately; each action designed to operate independently using fasteners that engage a handle into indentations in a lower cartridge rail and fasteners that engage a trigger into indentations in a connecting bar (otherwise referred to as a trigger bar) that extends back to a plunger advancing plate. Two examples of fastener types include locking tabs that slide up or down, or thread screws. A user is required to release a fastener that locks a handle to a gun, release a fastener that connects a trigger to a trigger bar, move the handle's position, then re-lock each fastener.

In a second embodiment, two separate sprung tabs engage a handle to indentations in a lower rail and a trigger to indentations in a trigger bar. These tabs are placed in alignment such that as a user pushes a button at the rear of said handle, a shaft, connected to said button and positioned inside said handle, engages said tabs. Said shaft moves forward, collapses said tabs simultaneously, permitting said handle to be positioned at a different point along the gun; releasing said button resets said tabs against said indentations. This arrangement requires that both tabs align with their respective indentations simultaneously for a handle and trigger to be reengaged for use.

With a third embodiment, a spool, positioned transversely to a handle, is connected to a trigger. A thin cable wraps around said spool, extends back, and is connected to a tab in a plunger advancing plate. When said trigger is squeezed, rather than spin, said spool locks and is pushed forward. To release said handle for repositioning along the gun, a forked tab attached to said handle slides up and down, releasing said handle from a lower cartridge rail. As said handle slides, said spool automatically picks up or releases slack on said cable as needed.

A fourth and preferred embodiment provides a sliding vertical forked tab at the rear of a handle, said tab engaging indentations in a lower cartridge rail; and a trigger including a toothed extension, a trigger bar having indentations, the extension and trigger bar indentations engaging only when the trigger is squeezed. A coil spring is positioned inside the trigger. One end of the coil spring biases the trigger away from the handle while the other end of the coil spring is attached to the tab. With this arrangement, a handle can be released, moved and then relocked in one easy maneuver using only a trigger.

Attached to the lower forward portion of a lower cartridge rail, a trigger bar bracket includes an opening to receive and support the front edge of a trigger bar, the front edge of said bar being sharpened or including a small blade. Another opening in the bracket allows nozzles of common cartridges to be inserted therein. The sharpened edge of the trigger bar and the body of the bracket thus form a guillotine type nozzle cutter.

A plunger restraining plate includes a leg extending rearwards and straddles the upwardly sloping rear portion of a trigger bar. As the trigger bar begins moving forward when a trigger is squeezed, it engages the leg, lifting it slightly releasing the plunger shaft. As the trigger is released, the actuator plate again lifts the leg of the retraining plate thereby delaying the restraining plate from locking onto the plunger shaft, thus permitting the shaft to slide rearwards slightly, relieving pressure on a cartridge. This action occurs automatically each time a trigger is released after being squeezed.

An arm clip, pivotally attached to a stock, gives an optional second point of contact with a user's arm to firmly secure the gun to the forearm of the user, while also providing greater support, accuracy and endurance.

Although multiple springs may be used to produce the actions necessary for the actuator plate and restraining plate to function, a single dual action spring design reduces the number of springs necessary to actuate the plates and simplifies the construction of the gun. The single spring design of the current invention is employable with a gun that does not have a sliding handle. In the preferred embodiment, a caulking gun includes a sliding handle, is manufactured as simply as possible and allows for both a handle and trigger to release for adjustment with one simple maneuver.

DETAILED DESCRIPTION OF THE ILLUSTRATED EMBODIMENTS

Figure 1:
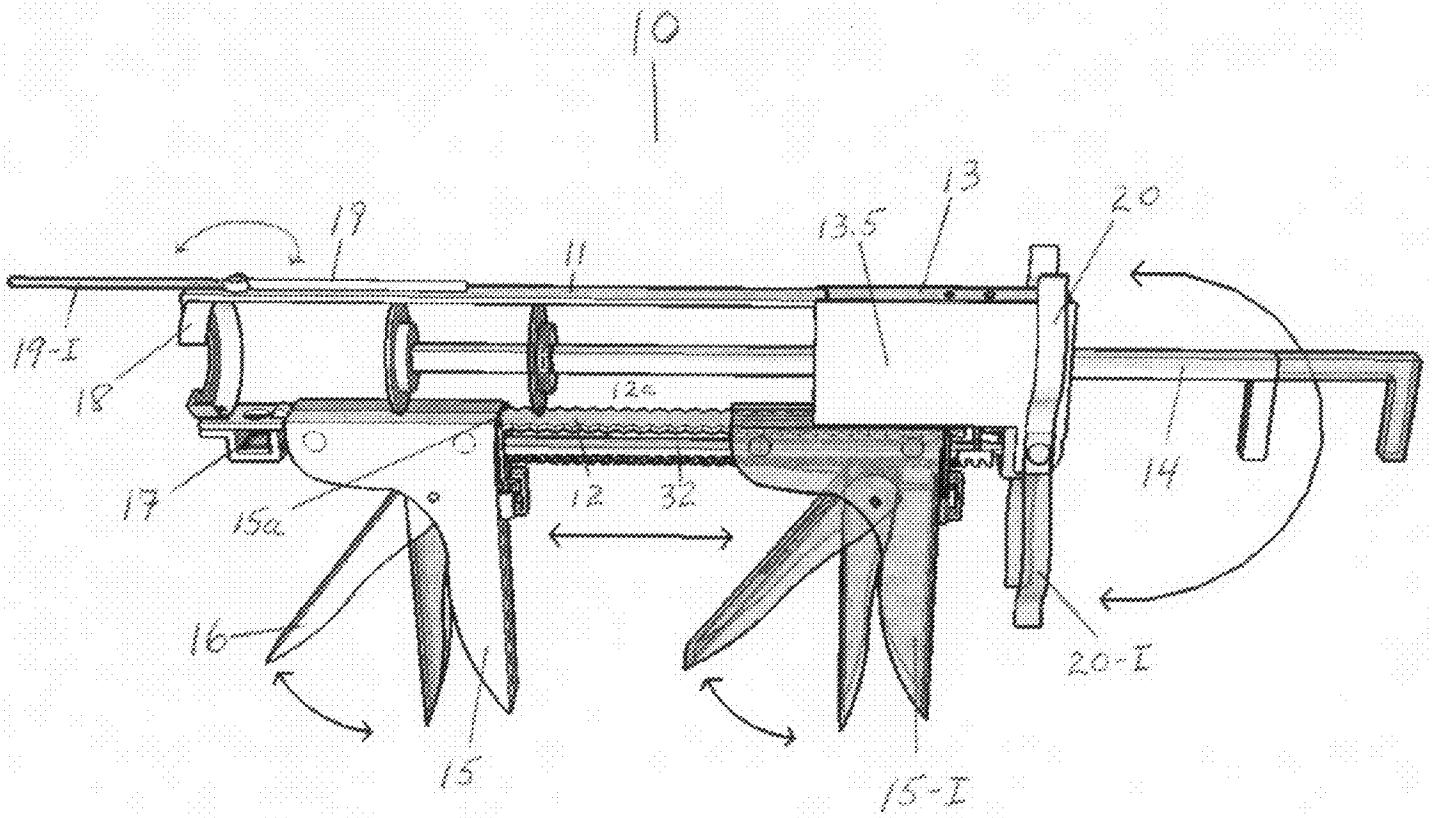
FIG. 1 is a side elevation, general view of a caulking gun with a sliding handle, shown set forward and shadowed in the rearward position, a pivotally mounted arm clip set upward and shadowed in the downward position, a pivotally mounted cartridge poker set retracted and shadowed in the extended position, and a nozzle cutter located near the front of the invention, away from the inside of said handle.

Referring to the drawings, in particular to FIG. 1, there is shown generally at (10) a caulking gun incorporating the features of the invention. The upper body of caulking gun (10) includes a cartridge holder defined by a disk (18) upper cartridge rail (11) and lower cartridge rail (12). A stock (13) with stock cover plate (13.5) wherein the cover plate overlaps and attaches to upper cartridge rail (11). Plunger shaft (14) passes through stock (13) and upper cartridge rail (11). Cartridge poker (19), pivotally mounted on upper cartridge rail (11), may be rotated 180 degrees forward, shown shadowed in forward position as poker (19-I). Arm clip (20), pivotally attached to stock (13), may be turned downwards 180 degrees, shown shadowed in downward position as clip (20-I).

A sliding handle (15) with trigger (16) includes sleeve (15*a*), permitting lower cartridge rail (12) to pass there through. Lower cartridge rail (12) includes indentations (12*a*) along its long axis. Handle (15) may be set anywhere along lower cartridge rail (12) at any given indentation (12*a*). Handle (15) also shown shadowed in the rearward position as handle (15-I). Nozzle cutter (17), attached to rail (12), supports the front edge of trigger bar (32).

Figure 2:
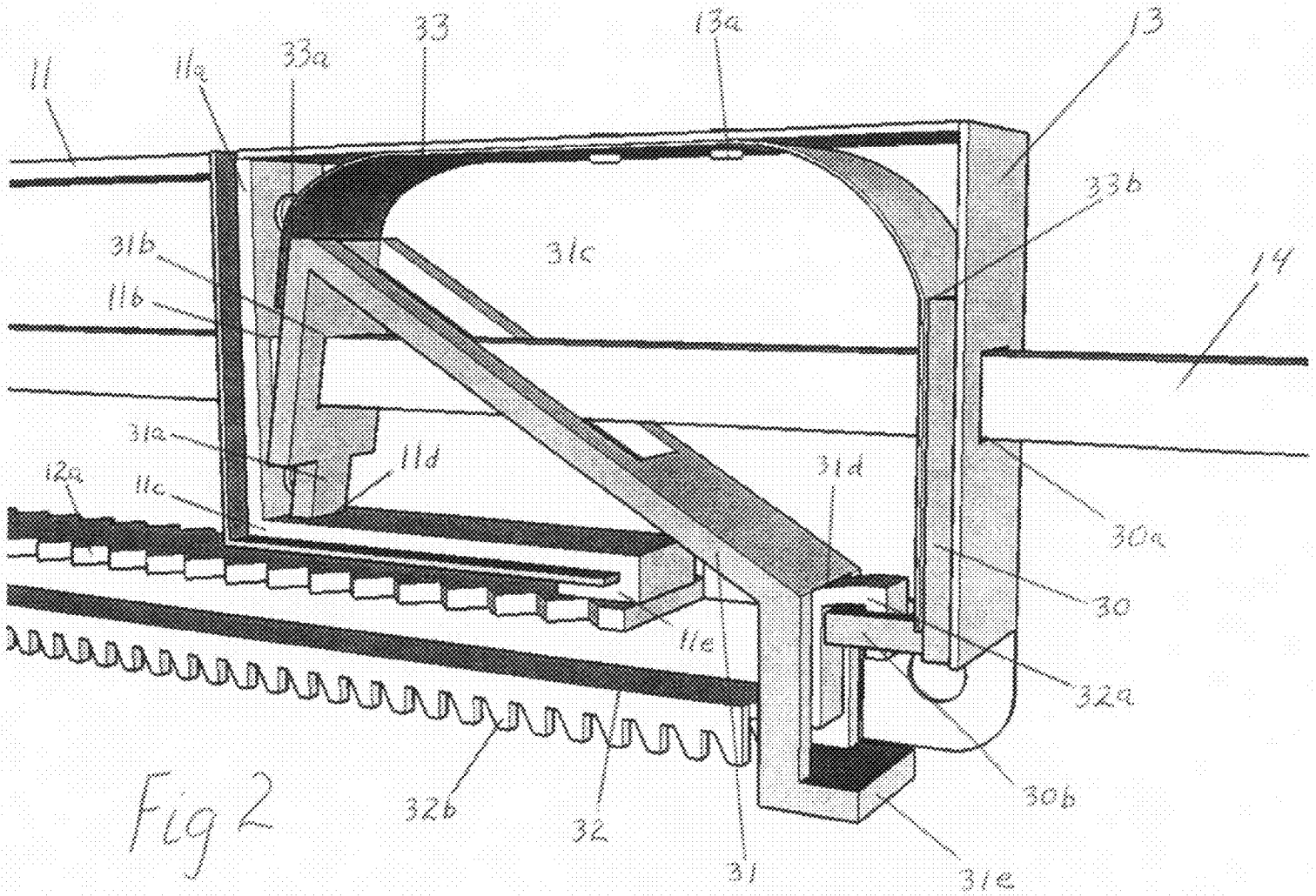
FIG. 2 is a side, sectional, perspective, inside view of a stock with stock cover removed, including actuator plates, an actuator leaf spring, trigger bar and plunger shaft.

Referring now to FIG. 2, there is shown a stock (13) with cover plate (13.5) having been removed for viewing, the upper cartridge rail (11) bends downward at point (11*a*); has a first hole or opening (11*b*) through which plunger shaft (14) passes, bends rearward again at point (11*c*) and contacts lower cartridge rail (12) at point (11*e*). Plunger restraining plate (31) is anchored with foot (31*a*) to upper cartridge rail (11) at point (11*d*); extends upwards; has opening (31*b*) through which plunger shaft (14) passes; and includes a leg that extends rearward and downward, plunger shaft (14) again passing through unrestricted at point (31*c*); bends downward and is forked at point (31*d*) leaving an angled plane to contact trigger bar (32) at a point (32*a*) only when trigger bar (32) moves forward; straddles trigger bar (32) bending rearward again and terminating with tab (31*e*). Plunger advancing plate (30) extends downward, has plunger shaft (14) pass through at a second hole or point (30*a*), extends further downward terminating with tab extension (30*b*). Actuator leaf spring (33) is attached to the upper inside plane of stock (13) at point (13*a*); contacts restraining plate (31) at point (33*a*) exerting rearward pressure on plate (31); and contacts actuator plate (30) at point (33*b*) exerting rearward pressure on plate (30). As trigger bar (32) moves forward when a trigger is squeezed, sloped segment (32*a*) forces plate (31) upwards at point (31*d*). Said motion releases shaft (14) at point (31*b*). As trigger bar (32) slides rearward when the trigger is released, plate (31) remains slightly elevated and is delayed in contacting shaft (14).

Figure 3:
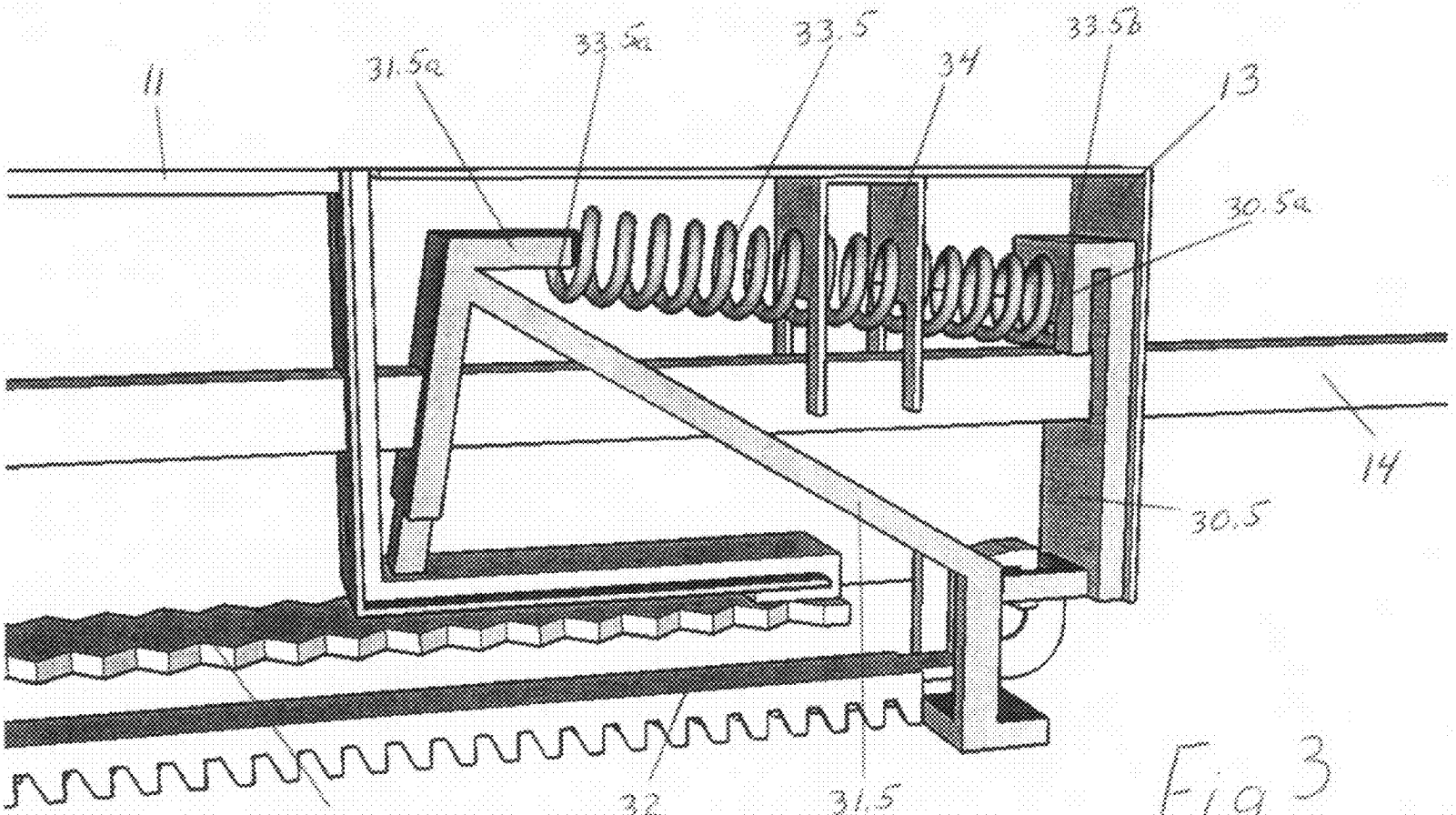
FIG. 3 is a side, sectional, perspective, inside view of a stock with stock cover removed, including actuator plates, an actuator coil spring, trigger bar and plunger shaft.

Referring now to FIG. 3, there is shown a second embodiment of an actuator spring using a coil spring (33.5) attached to stock (13) with bracket (34). Said spring attached to restraining plate tab (31.5*a*) at point (33.5*a*) and attached to plate (30.5) at point (33.5*b*); plate (30.5) using plate tab (30.5*a*) to keep spring (33.5) in place.

Figure 4:
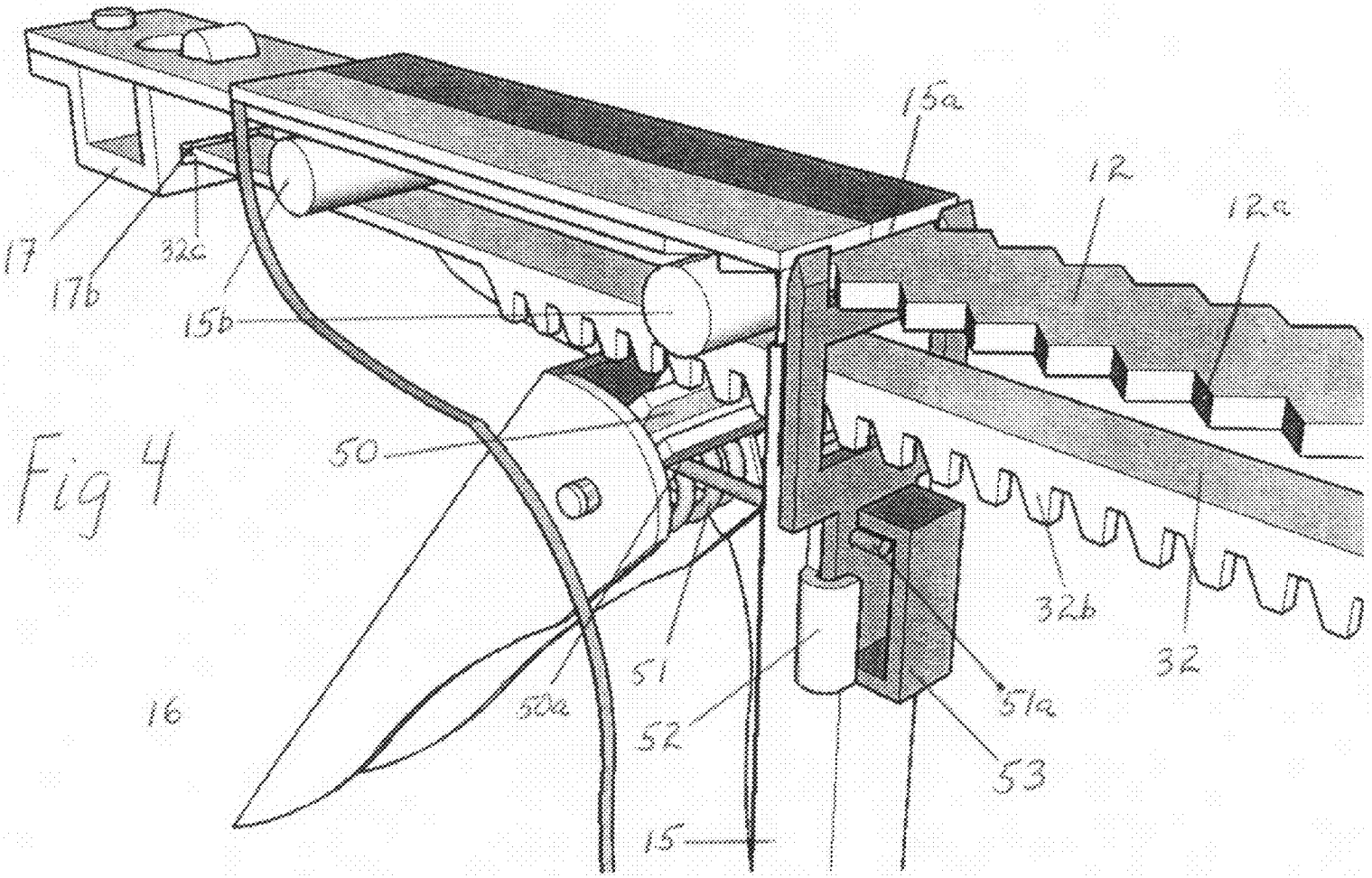
FIG. 4 is a side, sectional, perspective, inside exposed view of a handle, its side wall removed for viewing, including a handle monorail, a trigger, trigger extension, trigger spring, forked tab, tab bracket and a nozzle cutter.

Referring now to FIG. 4, there is shown a cross sectional view of a handle (15) which includes sleeve (15*a*) through which lower rail (12) passes there through, the monorail alignment secured with fasteners (15*b*). Forked tab (53) slides along bracket (52) and engages lower rail (12) at any of a series of indentations (12*a*). Spring (51), positioned inside trigger (16) engages tab (53) with spring end (51*a*). The upper portion of the trigger including indentations (50), positioned inside trigger (16) and straddling spring (51), contacts spring (51) at point (50*a*). The trigger indentations (50) engages trigger bar indentations (32*a*) only when trigger (16) is squeezed, as both trigger (16) and trigger indentations (50) rotate more vertically. When trigger (16) is lifted away from handle (15), the upper portion of the trigger (50) pushes spring end (51*a*) downward; spring end (51*a*) pushes tab (53) downward, disengaging tab (53) from rail indentations (12*a*). Trigger bar (32) extends forward, terminating at opening (17*b*) of bracket (17). A sharpened edge with blade (32*c*) rests on the edge of bracket (17).

Figure 5:
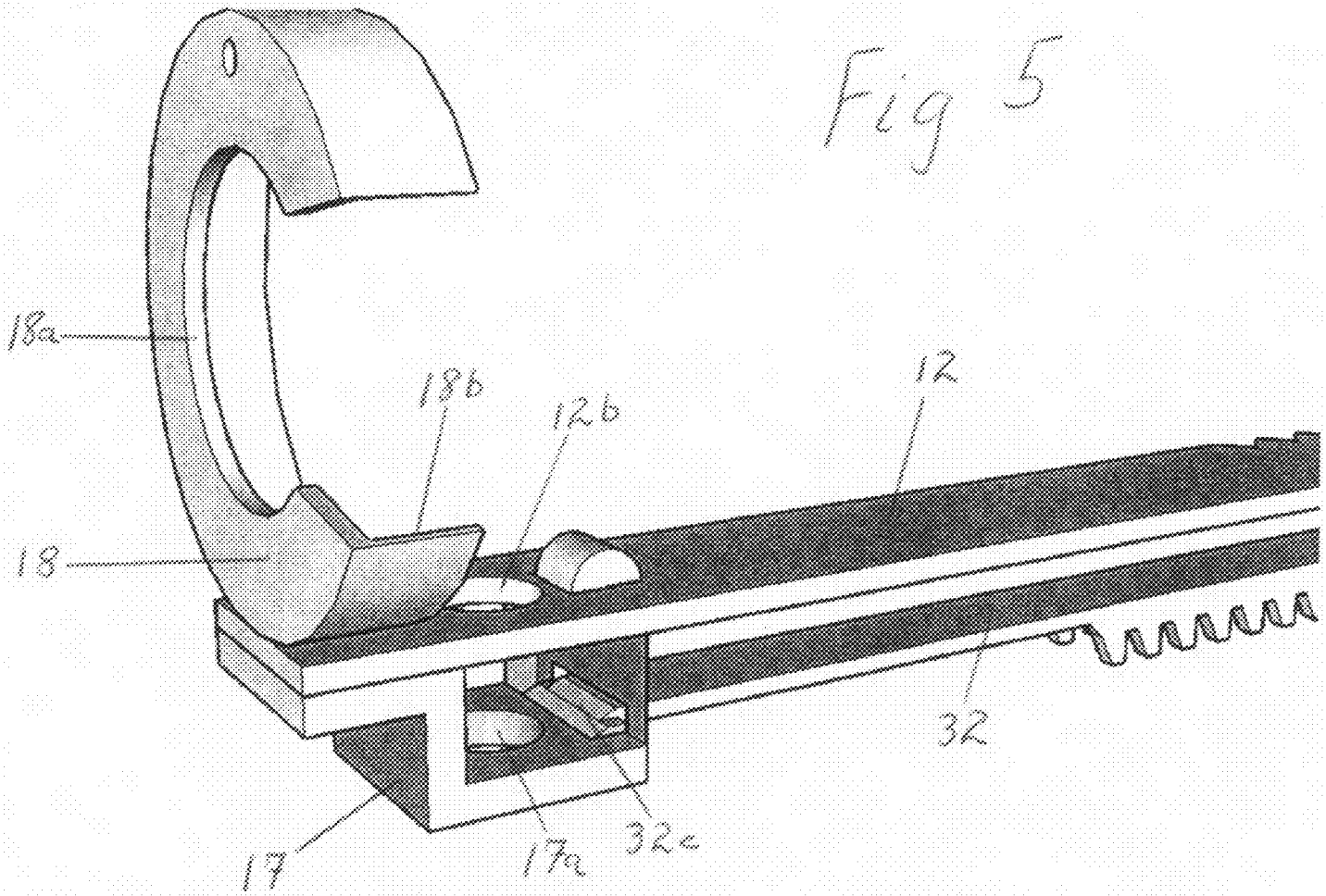
FIG. 5 is a side, sectional, perspective close up view of a nozzle cutter with a portion of the brace removed for viewing, exposing the trigger bar sharpened edge/blade.

Referring now to FIG. 5, there is shown a side, sectional view of nozzle cutter (17), a portion of bracket (17) removed, exposing the front edge of trigger bar (32). Bracket hole (17*a*) aligns with lower rail hole (12*b*) permitting a nozzle to be inserted and then sliced by edge (32*c*). Front disk (18) includes a flange (18*b*) for securing a body of a cartridge when a nozzle is inserted into opening (18*a*).

Figure 6:
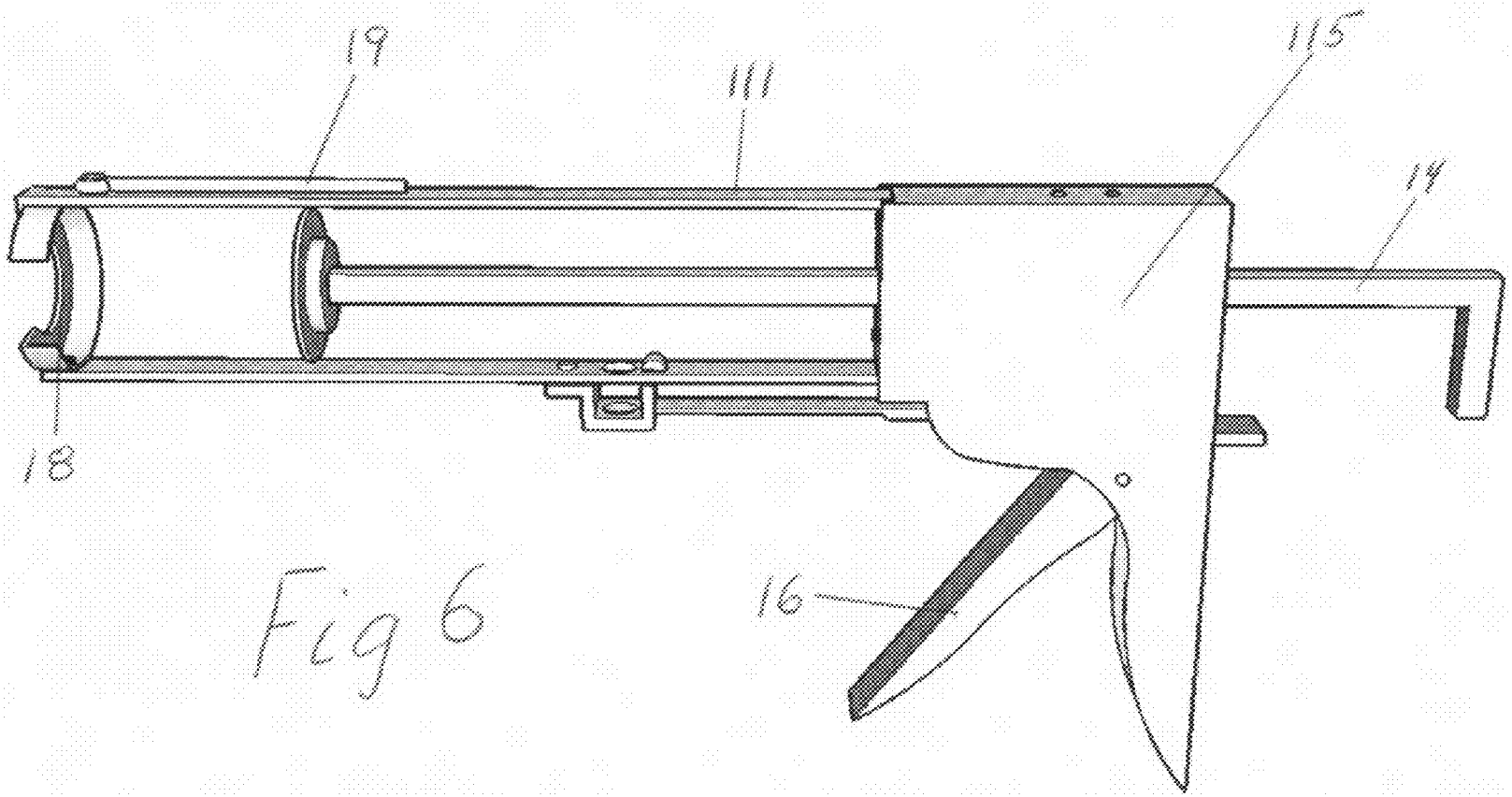
FIG. 6 is a side elevation, general view of a caulking gun with a stock with integrated non-sliding handle, a nozzle cutter still set away from said handle.

Referring now to FIG. 6, there is shown generally at (110) a caulking gun incorporating the actuating features of the invention with a non-sliding handle (115). Said gun includes a cartridge holder comprising disk (18); cartridge rail (111), said rail constructed to form both upper and lower portions of the cartridge rail as a continuous single piece; a plunger (14) a trigger (16); a nozzle cutter (17); and a cartridge poker (19).

Figure 7:
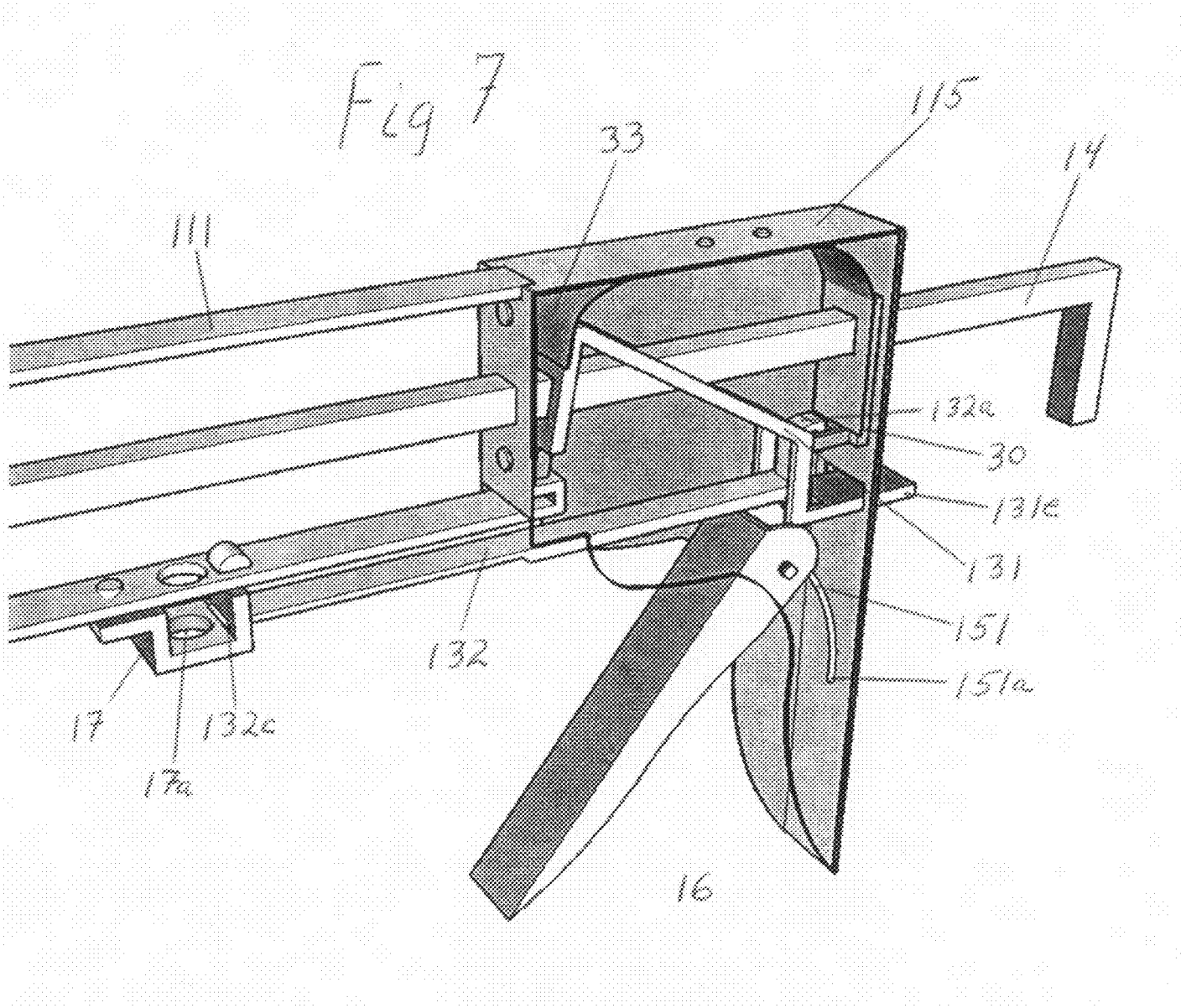
FIG. 7 is a side, sectional, perspective view of a caulking gun with a non-sliding handle, the side wall of said handle removed for viewing, exposing the hollow of a stock containing actuator plates, actuator leaf spring, plunger shaft and nozzle cutter.

Referring now to FIG. 7, there is shown a side, sectional, perspective view wherein cartridge rail (111) is formed from one continuous piece—forming both the upper and lower segments of the cartridge holder, the hollow of stock/handle (115) includes actuator spring (33), plunger advancing plate (30), a plunger restraining plate with a terminating rear tab (131*e*) extending past the rear of stock/handle (115), and a rearward end (151*a*) of a trigger spring (151) bends downward contacting the inside of stock/handle (115). Trigger bar (132) has only 2 teeth (blocked by plate (131)) and enters brace (17). Brace (17) includes an opening (17*a*), and bar (132) includes sharpened edge/blade (132*c*), both forming a guillotine type cutter.

Figure 8:
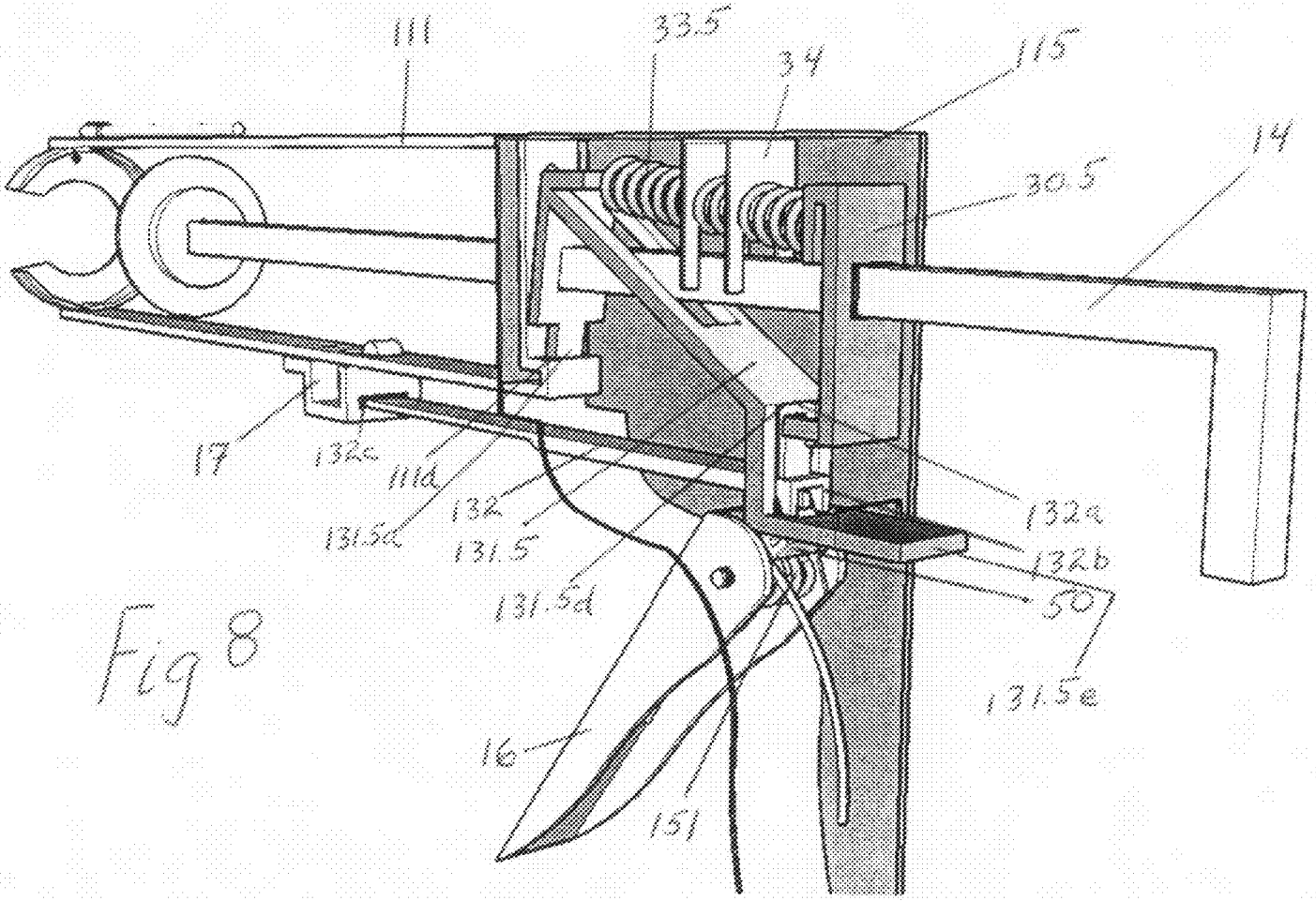
FIG. 8 is a side, sectional, perspective view of a caulking gun with a stock with integrated non-sliding handle, the side and rear walls of said handle removed for viewing, exposing a nozzle cutter, a trigger, a trigger spring, trigger extension, trigger bar, actuating plates, and actuator coil spring.

Referring now to FIG. 8, there is shown a side, sectional, perspective view of stock/handle (115), one side removed for viewing, a second embodiment of actuator coil spring (33.5) attached to stock/handle (115) with bracket (34). Plunger restraining plate (131.5) includes a tab (131*a*) that extends past the rear of stock/handle (115). Cartridge rail (111) is shown including hole (111*d*) into which foot (131.5*a*) of plate (131.5) is secured. Trigger bar (132) includes an upwardly sloped segment (132*a*) wherein said segment contacts and lifts plate (131.5) at point (131.5*d*), thus delaying plate (131.5) from restraining shaft (14) when trigger (16) is released after being squeezed.

We claim:

1. A caulking gun for a cartridge including an exit nozzle and containing caulk, the caulking gun comprising:

a cartridge holder, said cartridge holder including a transversely positioned frontal disk for receiving the exit nozzle;

an upper cartridge rail perpendicularly attached to an upper portion of said frontal disk and extending rearward, said upper cartridge rail bent downward at a rearward end; and a lower cartridge rail, perpendicularly attached to a lower portion of said frontal disk, said lower cartridge rail extending rearward and parallel to said upper cartridge rail and attached to the rearward end of said upper rail, said lower cartridge rail having indentations along its length;

a stock attached to said upper cartridge rail, said stock including a first hole in a front vertical segment of said stock and a second hole in a rear vertical segment of said stock, said first hole and said second hole in alignment with each other and situated midway between said upper cartridge rail and said lower cartridge rail;

a plunger shaft mounted through said first hole and said second hole;

a limiting means for limiting rearward movement of said plunger shaft, said limiting means including a vertically positioned restraining plate having a foot pivotally attached to said stock, said restraining plate further having an opening formed therein for loosely receiving said plunger shaft, said restraining plate restricting rearward movement of said plunger shaft as rearward force is exerted on an upper portion of said restraining plate;

an actuator plate;

dual function spring simultaneously exerting rearward force on said restraining plate and rearward force on said actuator plate;

a repositionable handle including a sleeve, said sleeve coplanar with and loosely attached to said lower cartridge rail, said handle thus movable forwardly and rearwardly along the length of said lower cartridge rail;

a trigger, pivotally attached to said handle, including trigger indentations at an upper end of said trigger;

a handle repositioning means, said repositioning means including a forked tab and a trigger coil spring, a first end of said coil spring contacting an inside of the trigger and a second end of said coil spring coupled to said forked tab, said forked tab movable upwardly against said lower cartridge rail as said trigger is squeezed thus engaging the indentations of said lower cartridge rail, or downwardly as said trigger is fully opened thus releasing said forked tab from said lower cartridge rail;

a plunger advancing means to advance the plunger shaft, said means including a trigger bar with trigger bar indentations, said trigger bar having a first end situated just behind and below said front disk and said lower cartridge rail, a trigger bar bracket, said first end of the trigger bar resting on an opening in the trigger bar bracket, said trigger bar bracket attached to said lower cartridge rail, said trigger bar extending rearward, passing through said handle below and parallel with said lower cartridge rail, said trigger bar having a second end entering said stock through a lower horizontal segment of said stock, said second end of the trigger bar attaching to a lower end of said actuator plate such that squeezing the trigger rotates the trigger toward a more vertical alignment against the handle, engaging the trigger indentations against the trigger bar indentations, moving said trigger bar forwardly, simultaneously pulling said actuator plate forward, said actuator plate rotating from a vertical position, pinching against said plunger shaft forcing it forward;

a nozzle cutting means for cutting a tip of said exit nozzle, said nozzle cutting means including a small opening in a lower horizontal segment of said trigger bar bracket able to receive the tip, said first end of the trigger bar also including a sharpened edge, said sharpened edge moving forwardly through and inside said bracket opening each time said trigger is squeezed, said moving producing a guillotine action; and a retractable, adjustable and arm securing arm clip, said arm clip tensioned to hold securely to a user's forearm yet adjustable to conform to the user's arm.

2. A caulking gun according to claim 1 wherein a general midsection of the dual function spring attaches to an inside upper horizontal segment of the stock.

3. A caulking gun according to claim 1 wherein the handle repositioning means includes a tab bracket, wherein said forked tab is able to slide along said tab bracket, releasing the handle from the lower cartridge rail only when a user forcibly pivots said trigger upwardly, and wherein said forked tab is positioned to relock said handle at any point along said lower cartridge rail as the trigger is squeezed.

4. A caulking gun according to claim 1 wherein the trigger indentations touch and engage the trigger bar indentations only when said trigger rotates toward a more vertical alignment as it is squeezed.

5. A caulking gun according to claim 1 wherein said retractable, adjustable and arm securing arm clip is made of a suitable flexible material, said flexible material having a memory to remain in a closed position even after being opened repeatedly, pivotally attached to said stock; said retractable, adjustable and arm securing arm clip, when turned upward, remains closed around the stock and out of a way of the user and when turned downward, holds securely and comfortably around the user's arm, providing a firm, positive secondary contact point with the user.

6. A caulking gun according to claim 1 wherein said trigger bar has a slightly upwardly sloped notch at its rearward end as it extends backwards within the stock in front of and near a connection point with the actuator plate, and wherein the restraining plate includes a rearwardly extending diagonally positioned leg that nearly touches said sloping notch of said trigger bar when the trigger is in a rest position, said trigger bar engaging and lifting momentarily said restraining plate leg into a slightly more horizontal alignment, said lifting pivoting the vertical portion of said restraining plate into a more vertical alignment with the plunger shaft thus releasing said plunger shaft from restrainment by the restrainment plate each time the trigger bar moves forward or rearward; and, as a trigger is released, said restraining plate is positioned to delay in restraining said plunger shaft until said bar nearly completely returns to the rest position, said delay permitting said plunger shaft to move slightly backwards away from a cartridge, relieving pressure inside said cartridge.

7. A method for disengaging and reengaging a sliding handle of a caulking gun using a trigger comprising the steps of:

lifting said trigger upwardly away from said handle, said motion pivoting upper portion of said trigger extending above a pivot point downwards, such that said upper portion of the trigger engages and pushes a rearward facing end of a trigger spring downwards, said rearward facing end attached to a forked tab at a rear of said handle, in turn forcing said forked tab downwards to disengage said handle from a first indentation of a rail;

moving said handle from a first position to a second position along the rail;

once said handle has been repositioned to the second position, squeezing said trigger downward such that tension is increased on said trigger spring, thus pushing said forked tab upwards into a second indentation of said rail, reengaging and locking said handle into the second position;

releasing the squeezing of said trigger to allow a force of the trigger spring to pivot the upper portion of the trigger until it comes to rest against the rearward facing end of the trigger spring, thereby allowing said trigger to be repeatedly squeezable by a user at the second position without releasing the handle from the rail, yet permitting the user to easily reposition the handle as desired.

* * * * *